US006257691B1

(12) United States Patent
Iwasaki et al.

(10) Patent No.: US 6,257,691 B1
(45) Date of Patent: Jul. 10, 2001

(54) INK JET RECORDING APPARATUS AND METHOD

(75) Inventors: Osamu Iwasaki, Tokyo; Noribumi Koitabashi, Yokohama; Kaneji Yamada, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/025,654

(22) Filed: Feb. 18, 1998

(30) Foreign Application Priority Data

Feb. 19, 1997 (JP) ..... 9-034838

(51) Int. Cl.[7] ..... B41J 29/38; B41J 2/205; B41J 2/14

(52) U.S. Cl. ..... 347/15; 347/11; 347/48

(58) Field of Search ..... 347/15, 48, 9, 347/67

(56) References Cited

U.S. PATENT DOCUMENTS 5,420,618 * 5/1995 Sekiya et al. ..... 347/9
5,576,745 * 11/1996 Matsubara ..... 347/18
5,731,828 * 3/1998 Ishinaga et al. ..... 347/62
5,896,146 * 4/1999 Murata et al. ..... 347/42

* cited by examiner

*Primary Examiner*—John Barlow
*Assistant Examiner*—Alfred Dudding
(74) *Attorney, Agent, or Firm*—Fitzpatrick, Cella, Harper & Scinto

(57) ABSTRACT

Small dots and large dots are recorded with a sufficient difference between them by such structure that a plurality of heat generating elements are disposed inside of each nozzle. A single pulse is applied to one heat generating element for recording of a small dot, whereas a single pulse and a divided pulse are applied to two heat generating elements for recording of a large dot. When the divided pulse is applied to the heat generating element, a larger amount of the ink is ejected than upon application of the single pulse. Therefore, the sufficient difference can be generated between the sizes of dots by applying the driving pulses as described above.

14 Claims, 10 Drawing Sheets

INK JET RECORDING APPARATUS AND METHOD

BACKGROUND OF THE INVENTION

1. Field of the Invention

The present invention relates to an ink jet recording apparatus and method of the thermal type and, more particularly, to an ink jet recording apparatus and method using a plurality of heat generating elements disposed inside each of nozzles for ejecting ink.

2. Related Background Art

Various recording devices are used under various circumstances nowadays and, particularly, the ink jet recording apparatus of the thermal type is widespread as a recording apparatus quiet in operation and simple in structure. This ink jet recording apparatus of the thermal type is constructed generally such that a lot of nozzles for ejecting the ink from a recording head are juxtaposed and that a heat generating element is disposed inside each nozzle. In the ink jet recording apparatus of this type, a bubble is generated momentarily in the ink by heat generated by each heat generating element and the ink is ejected from the recording head by pressure of the bubble.

There is an example of such ink jet recording apparatus proposed in such an arrangement that a plurality of (for example, two) heat generating elements are disposed inside each nozzle and that the number of heat generating elements driven at one time is changed to change an ejection amount of ink, thereby permitting two-stage switching of resolution. Specifically, the two heat generating elements in each nozzle are driven simultaneously for carrying out recording in a low resolution but at high speed, whereby a large quantity of the ink is ejected from each nozzle to record a large dot on a print sheet. Only one of the heat generating elements is driven in each nozzle for carrying out recording in a high resolution but at low speed, whereby the ejection amount of ink is reduced to a half to record a small dot on the print sheet.

Also described is a configuration for realizing recording in multi-level gradations by the similar arrangement in which a plurality of heat generating elements are disposed inside each nozzle and in which the ejection amount of ink is changed according to the number of heat generating elements driven at one time.

There is also another proposal for increasing the ejection efficiency of ink by designing of pulses applied to the heat generating elements. Namely, it is found that the ejection amount of ink is increased by application of a divided pulse rather than by application of a simple single pulse to the heat generating element, even though the energy applied is equal. There is thus such a proposal that two heat generating elements are disposed inside each nozzle, a divided pulse is applied to one heat generating element for recording of a small dot, and a divided pulse is applied to the both of the two heat generating elements for recording of a large dot, thereby recording small and large dots with high efficiency.

With the ink jet recording apparatus wherein the plural heat generating elements are disposed in each nozzle as described above, gradients of image recording can be changed in dot units.

For changing gradients in two levels as described above, a preferred and simple structure is such that only two heat generating elements having the same size and shape are provided in each nozzle. It was, however, found that it was difficult to double the ejection amount of ink by changing the number of heat generating elements driven between one and two in this structure. Namely, it was difficult to generate a difference enough to achieve the two-level gradients, because the diameter of the small dot was not small enough as compared to the diameter of the large dot.

It is not impossible to generate a sufficient difference between the small dot and the large dot, for example, by disposing three or more heat generating elements inside each nozzle, driving only one heat generating element for formation of a small dot, and driving all the heat generating elements for formation of a large dot. Further, it is not impossible to generate a sufficient difference between the small dot and the large dot by forming a small heat generating element and a large heat generating element in each nozzle, driving only the small heat generating element for formation of a small dot, and driving all the heat generating elements for formation of a large dot.

However, these techniques decrease the productivity of the ink jet recording apparatus, because the structure of the heat generating elements is complicated and the designing of the heat generating elements becomes more difficult. In addition, the resolution also decreases, because it becomes difficult to locate the nozzles in high density. It is thus preferred that the small dots and large dots be able to be recorded with a sufficient difference by the simple structure in which only two heat generating elements of an identical shape are disposed in each nozzle.

The present invention has been accomplished in view of the above issues and an object of the present invention is to provide an ink jet recording apparatus and method capable of generating the sufficient difference for multi-level resolutions by simple structure.

SUMMARY OF THE INVENTION

An ink jet recording apparatus of the present invention is an ink jet recording apparatus comprising: a nozzle for ejecting ink; a plurality of heat generating elements disposed inside said nozzle; single pulse applying means for applying a single pulse to at least one said heat generating element, said single pulse ejecting one droplet of the ink from said nozzle upon single application thereof; divided pulse applying means for applying a divided pulse to at least one of the other said heat generating elements, said divided pulse ejecting one droplet of the ink from said nozzle upon single application thereof; and operation control means for performing a changeover between a first state in which said single pulse applying means is operated singly and a second state in which both of said single pulse applying means and said divided pulse applying means are operated.

An ink jet recording method of the present invention is an ink jet recording method for driving a plurality of heat generating elements disposed inside a nozzle for ejecting ink, wherein a first state and a second state are provided so as to be switchable, wherein said first state is a state in which a single pulse is applied to at least one said heat generating element, said single pulse ejecting one droplet of the ink from said nozzle upon single application thereof, and wherein said second state is a state in which said single pulse is applied to at least one said heat generating element while a divided pulse is applied to at least one of the other heat generating elements, said divided pulse ejecting one droplet of the ink from said nozzle upon single application thereof, the ink jet recording method comprising performing a changeover between the first state and the second state.

In the configuration of the present invention as described above, when the plural heat generating elements disposed in the nozzle are driven, the ejection amount of ink can be changed by switching the operation mode between the first state in which the single pulse applying means is operated singly and the second state in which the both of the single pulse applying means and divided pulse applying means are operated.

This permits a sufficient difference of ejection amount of ink to be generated between the ejection amount of the ink in the first state and the ejection amount of the ink in the second state, thus realizing satisfactory gradation expression.

The present invention can be applied to the ink jet recording apparatus of the structure wherein a plurality of heat generating elements are disposed in each of nozzles for ejecting the ink, and in the product level, the invention can be applied to printers, copiers, facsimile machines, ink jet cartridges detachably mounted on these devices and so on. The present invention permits various arrangements for the plural heat generating elements located inside the nozzle; for example, the plural heat generating elements can be juxtaposed in the direction perpendicular to the ink ejection direction, or the plural heat generating elements in such an arrangement can be further displaced relative to each other in the ink ejection direction.

The single pulse applying means and divided pulse applying means apply the single pulse and divided pulse, respectively, to the heat generating elements and can be, for example, one in which a control circuit of operation timing is connected to driver circuits of the heat generating elements. The single pulse applying means applies one pulse for single ejection of ink and the divided pulse applying means applies a pulse including a plurality of pulses for single ejection of ink.

In another aspect of the above ink jet recording apparatus and recording method according to the present invention, the operation control means operates the single pulse applying means and divided pulse applying means at the respective times to achieve substantially simultaneous generation of bubbles in the ink in the second state. Accordingly, in the second state bubbles are generated substantially simultaneously in the ink at the position of the heat generating element driven by the single pulse and at the position of the heat generating element driven by the divided pulse, so that the ink is ejected in a sufficiently large amount by the bubbles generated at the positions of these heat generating elements. The times to achieve the substantially simultaneous generation of bubbles in the ink may be determined, for example, in such a manner that application of the single pulse is started from an almost midpoint of a quiescent period of the divided pulse.

In another aspect of the above ink jet recording apparatus and recording method according to the present invention, the divided pulse is set so that the pre-pulse of the pulse application period at least so short as not to generate the bubble in the ink and the main pulse of the pulse application time long enough to generate the bubble in the ink are consecutively provided with the predetermined quiescent period in between. Accordingly, the heat generating element is pre-heated up to a temperature not to generate the bubble in the ink by the pre-pulse and then is heated to a temperature to generate the bubble in the ink by the main pulse, so that the bubble is characteristically generated well within the ink, thus ejecting a large amount of ink.

In another aspect of the above ink jet recording apparatus and recording method according to the present invention, an application period of the single pulse satisfies such a relation that the application period of the single pulse is nearly equal to a total period of an application period of the pre-pulse and an application period of the main pulse of the divided pulse. Accordingly, the total period of the divided pulse is equal to the period of the single pulse, so that loads are equal on the single pulse applying means and on the divided pulse applying means.

In another aspect of the above ink jet recording apparatus and recording method according to the present invention, when the pulse application period necessary for the generation of a bubble in the ink by application of a pulse is Pth, the following relations are satisfied:

$$Pf1 \simeq 1.44 \times Pth,$$

$$Pb1 < 0.64 \times Pth,$$

$$Pb3 \simeq 1.44 \times Pth - Pb1,$$

Accordingly, the application period of the single pulse is about 1.44 times the pulse application period necessary for the generation of a bubble in the ink, so that the ink is characteristically ejected stably. Since the application period Pb1 of the pre-pulse of the divided pulse is shorter than 0.64 times the period necessary for the generation of a bubble in the ink, the heat generating element is pre-heated up to the temperature not to generate the bubble in the ink by the pre-pulse. Since the application period of the divided pulse consisting of such pre-pulse and main pulse is also about 1.44 times the period necessary for the generation of bubble in the ink, the ink is also characteristically ejected stably by the divided pulse. The period necessary for the generation of the bubble in the ink is a period of time after application of a pulse to a heat generating element and before start of bubble generation in the ink.

DETAILED DESCRIPTION OF THE PREFERRED EMBODIMENTS

Figure 1:
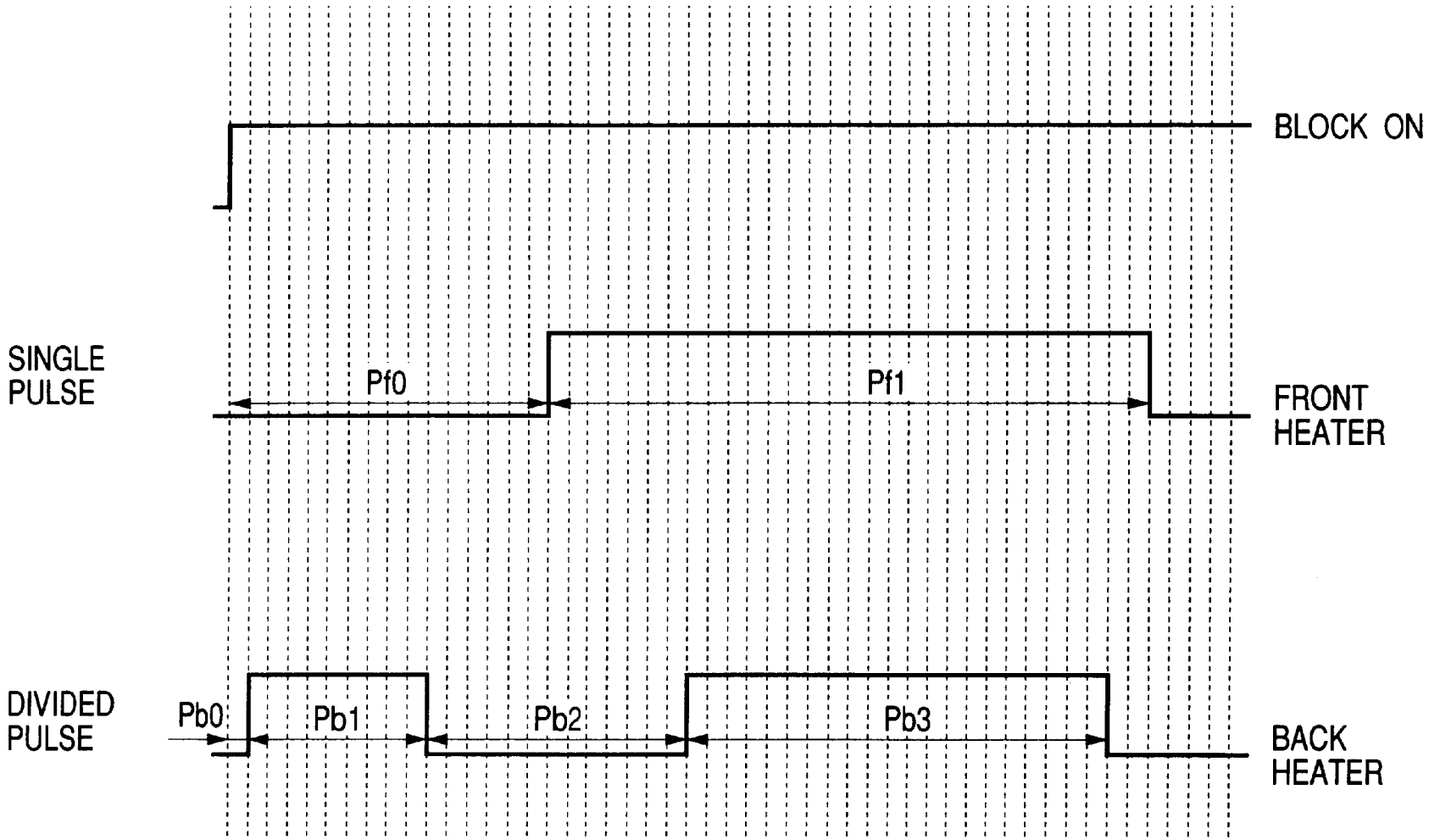
FIG. 1 is a timing chart to show a single pulse and a divided pulse in the ink jet recording apparatus as an embodiment of the present invention.
Figure 2:
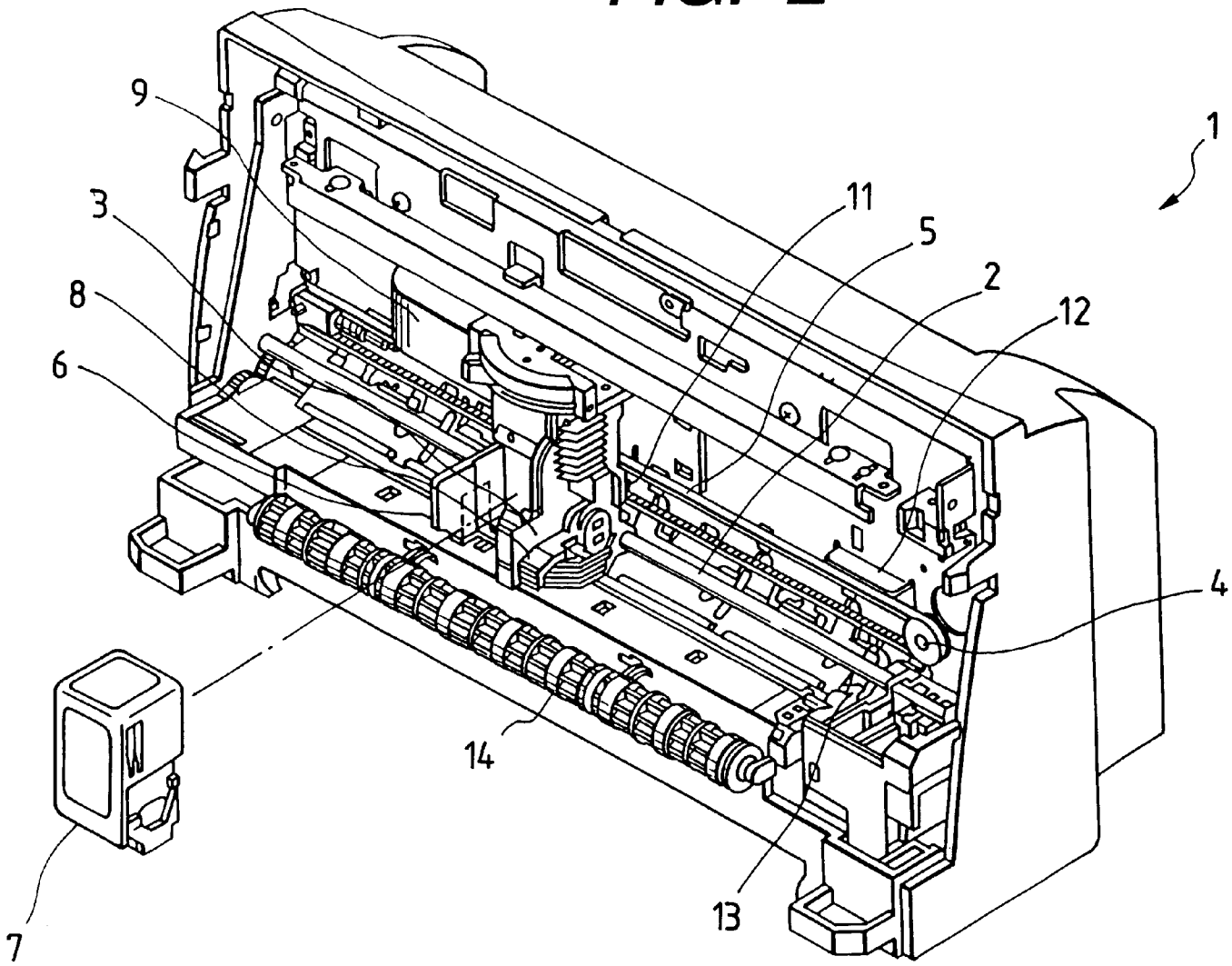
FIG. 2 is a perspective view to show the internal structure of the ink jet recording apparatus.
Figure 3A:
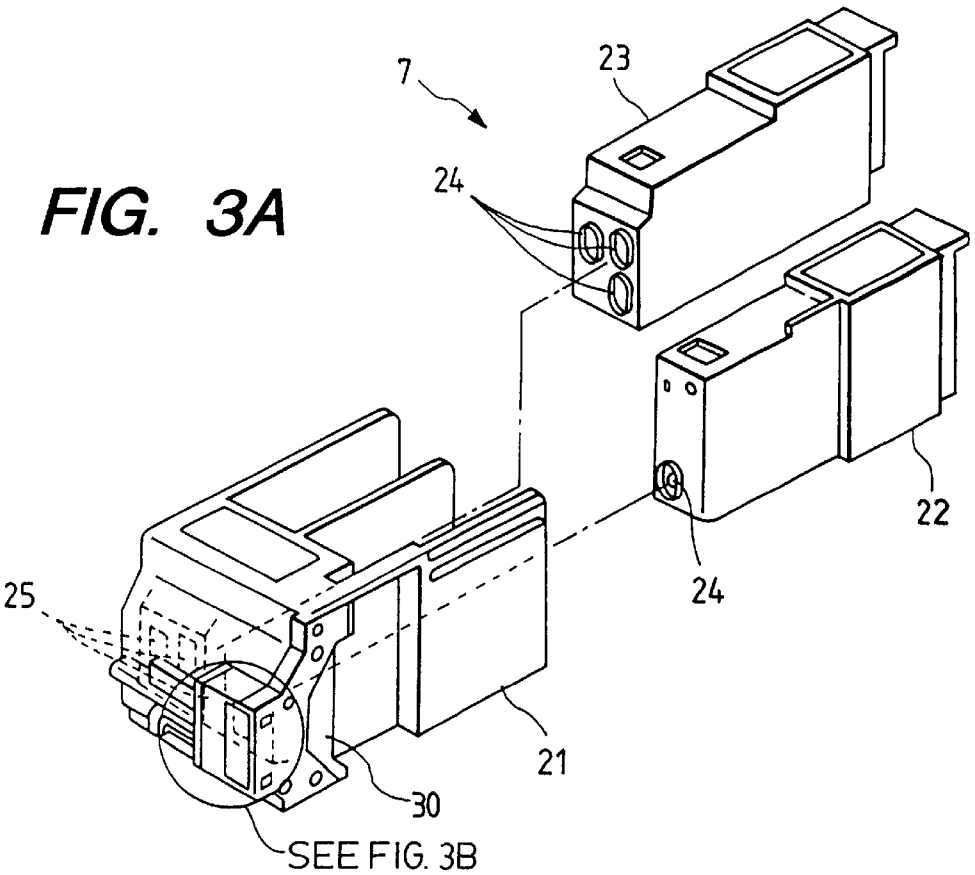
FIGS. 3A and 3B are is an exploded perspective view and an enlarged view to show an assembly structure of an ink jet cartridge.
Figure 3B:
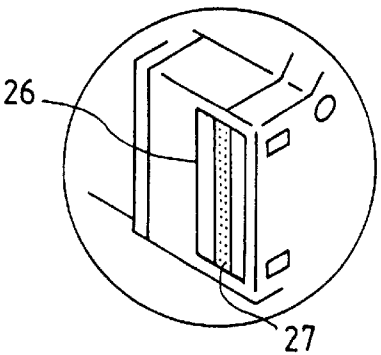
Figure 4:
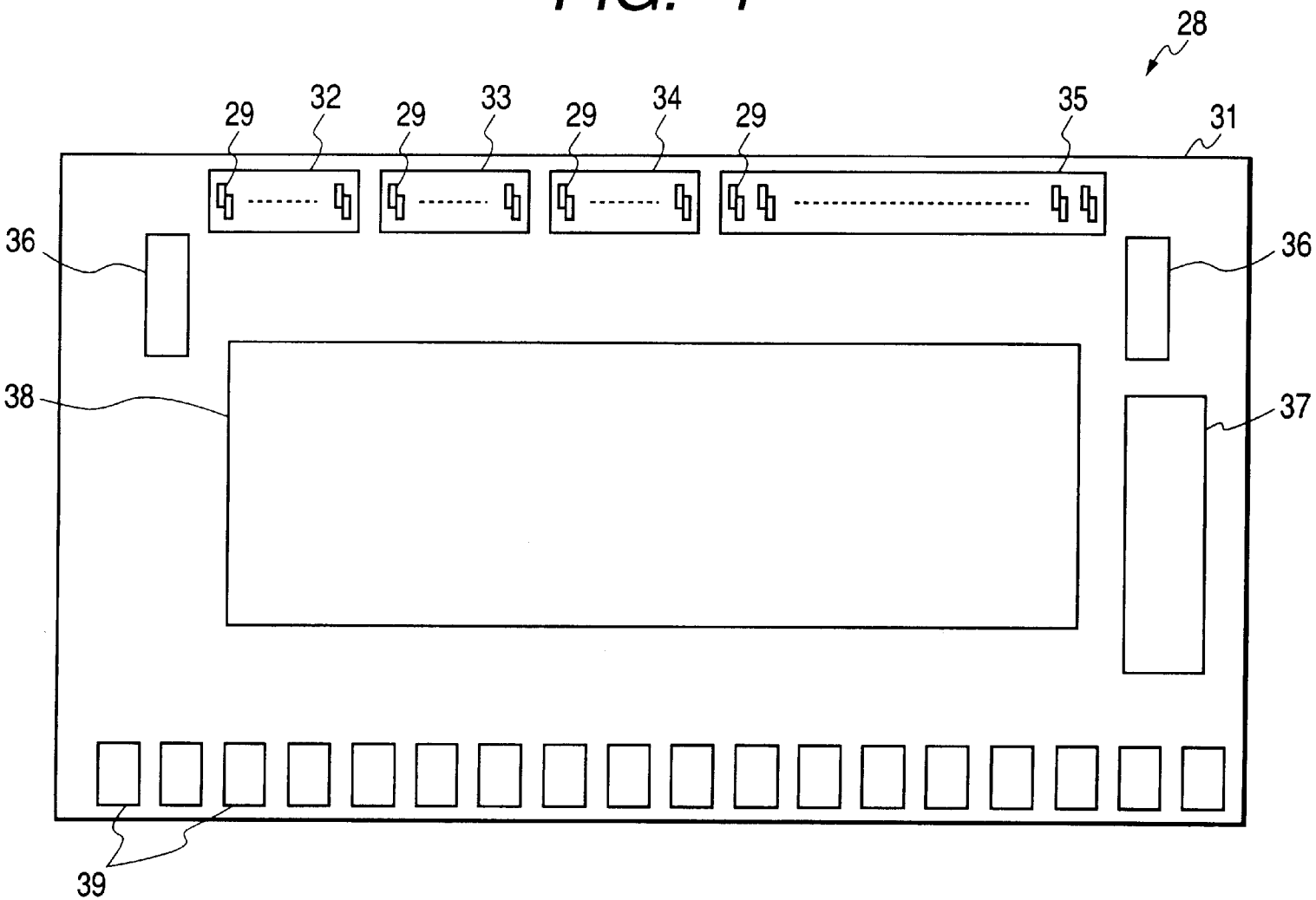
FIG. 4 is a plan view to show a head board.
Figure 5:
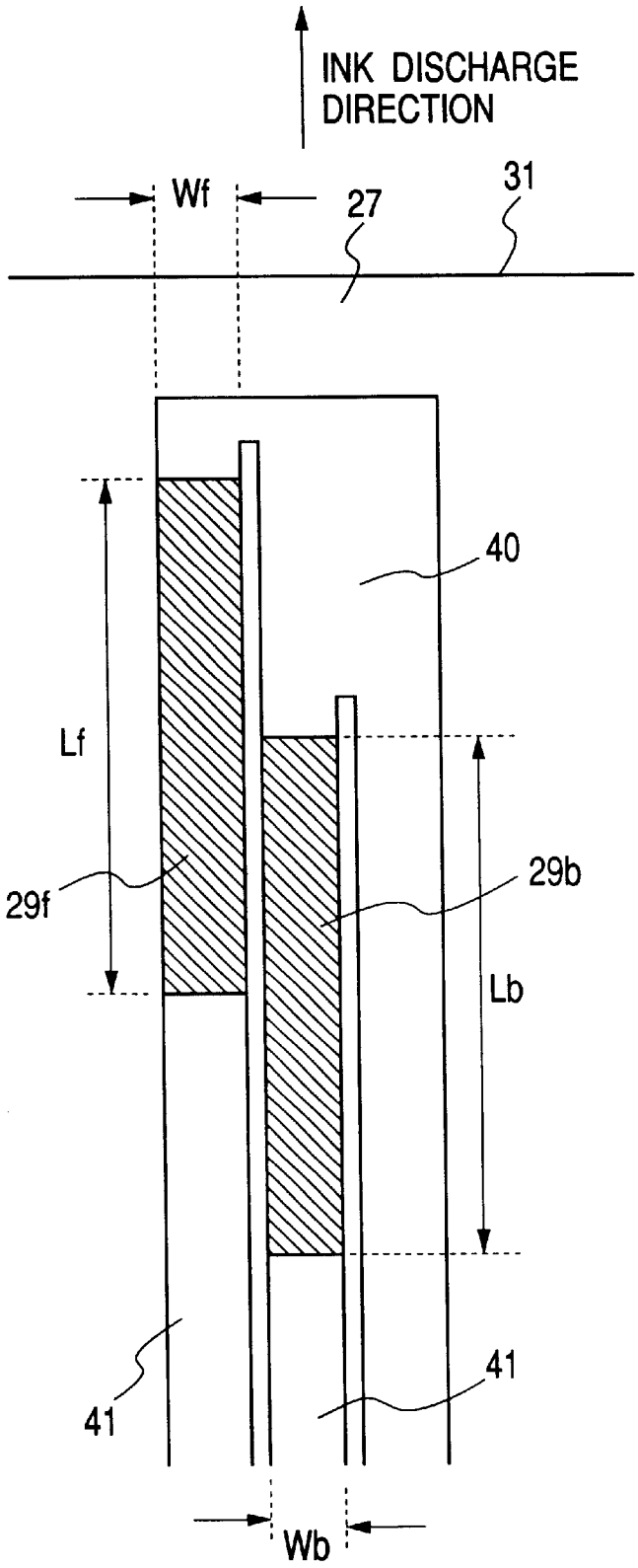
FIG. 5 is a plan view to show shapes of a front heater and a rear heater being heat generating elements.
Figure 6:
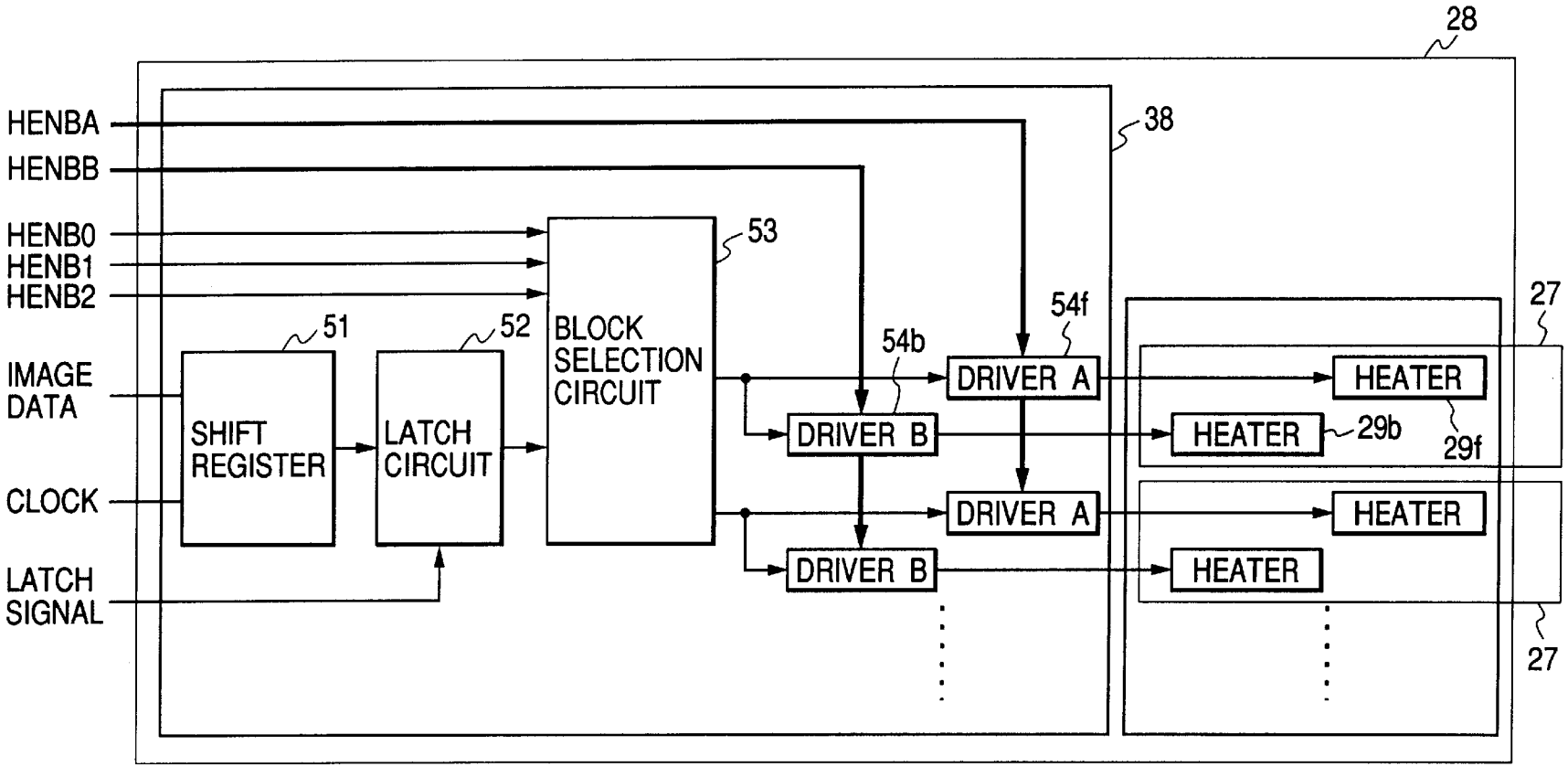
FIG. 6 is a block diagram to show a driving circuit mounted in the ink jet cartridge.
Figure 7:
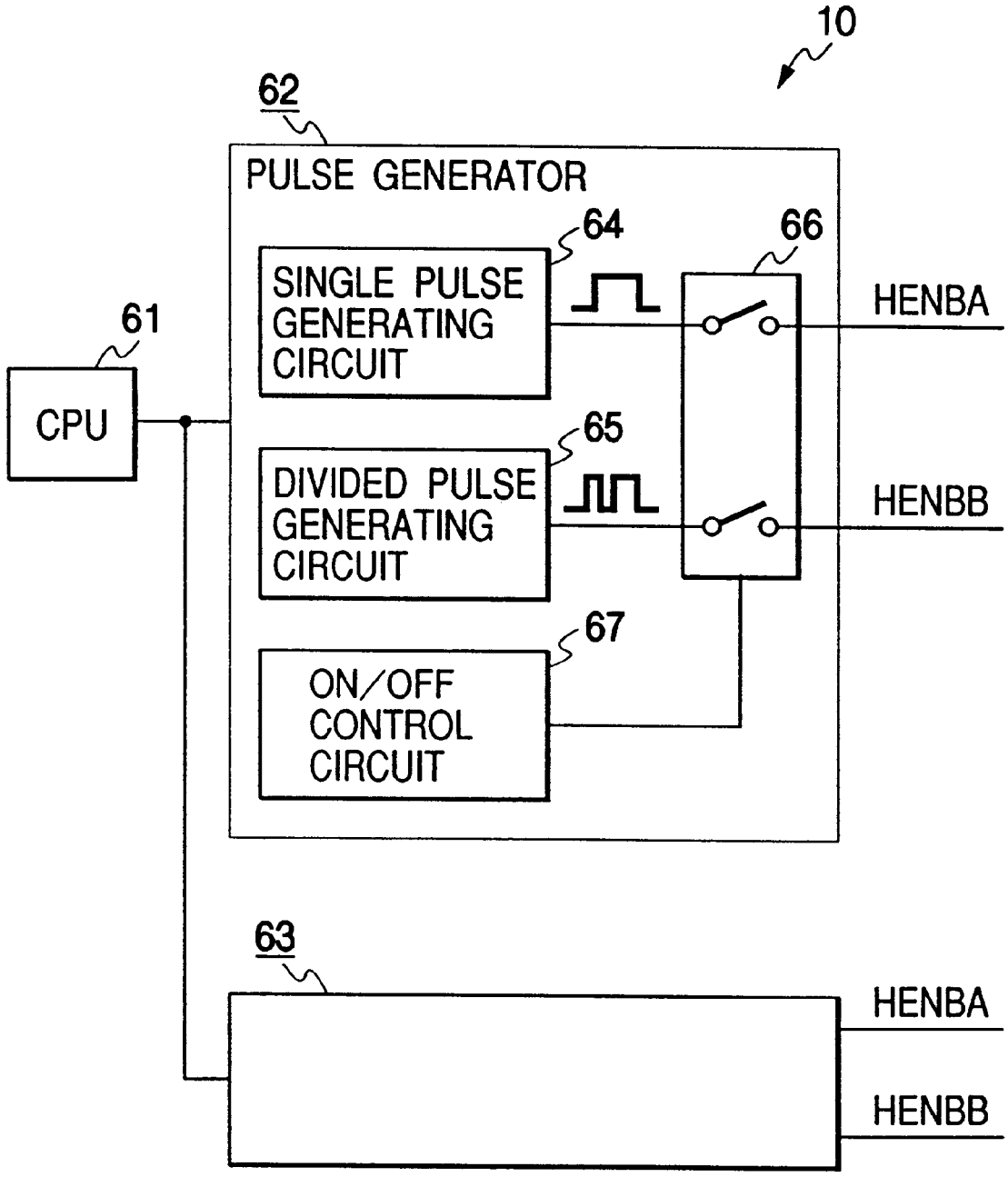
FIG. 7 is a block diagram to show a driving circuit mounted in the apparatus body.
Figure 8:
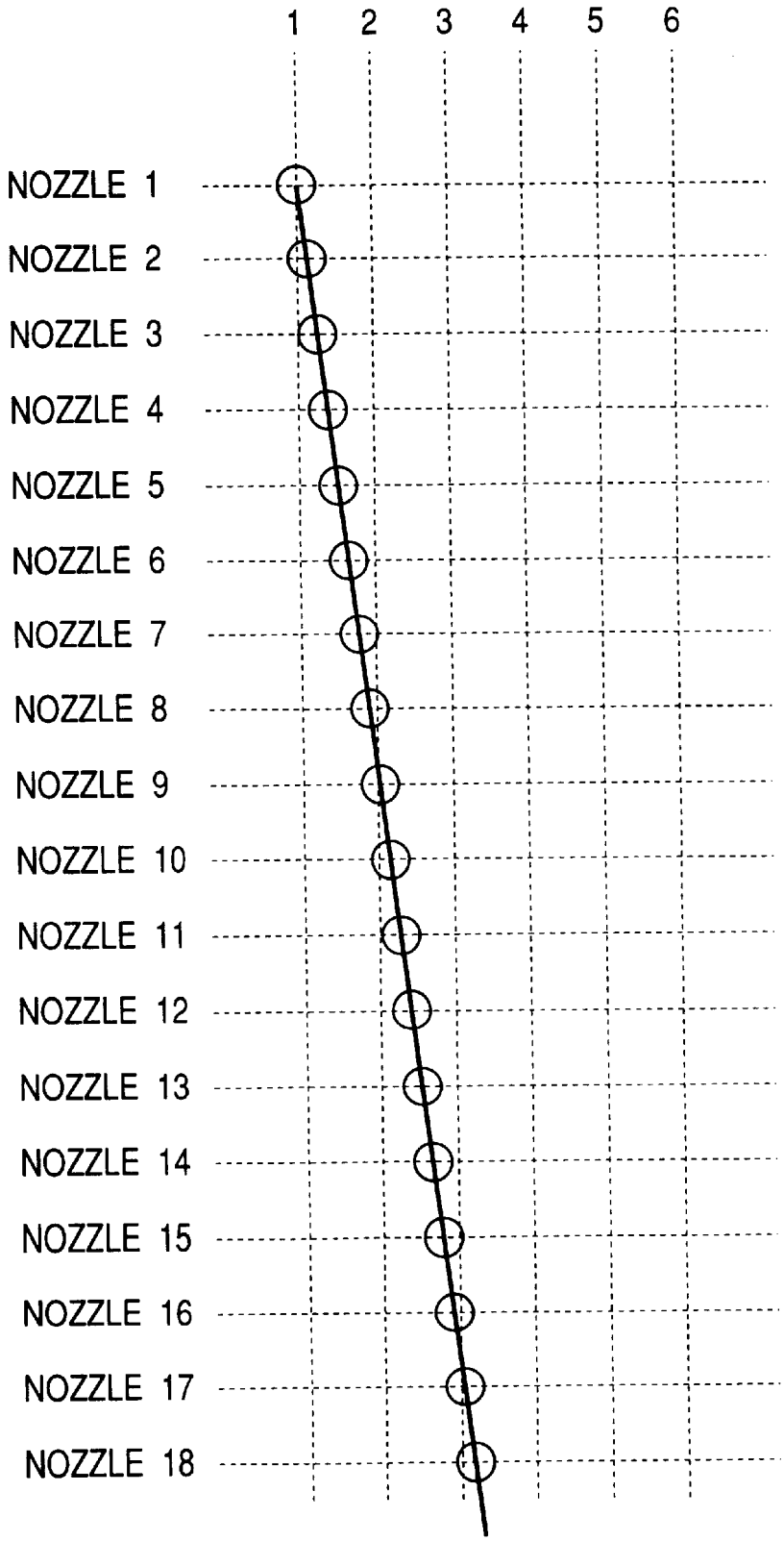
FIG. 8 is a schematic diagram to show an arrangement of nozzles in the main scanning direction and in the sub-scanning direction.
Figure 9:
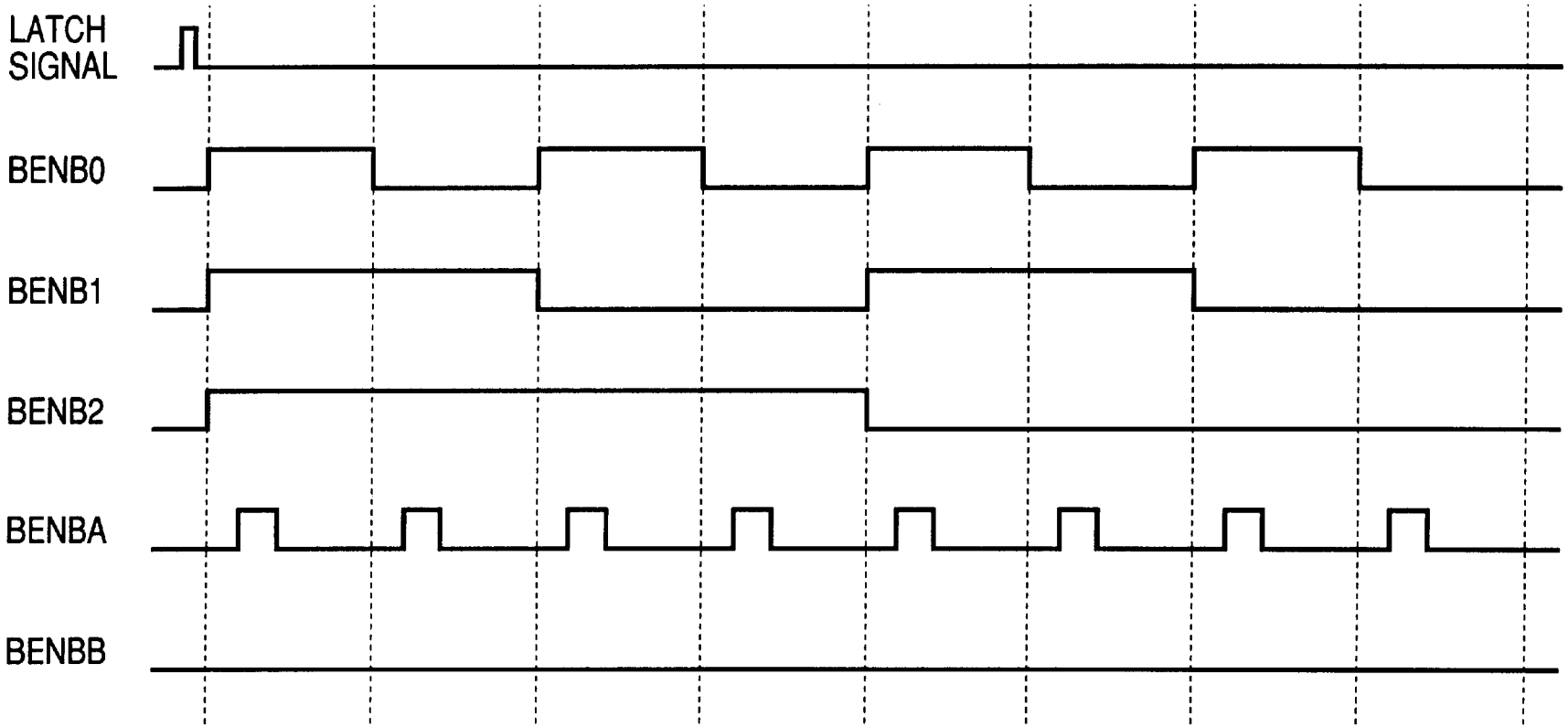
FIG. 9 is a timing chart to show signals in respective portions in a high resolution mode which is the first state.
Figure 10:
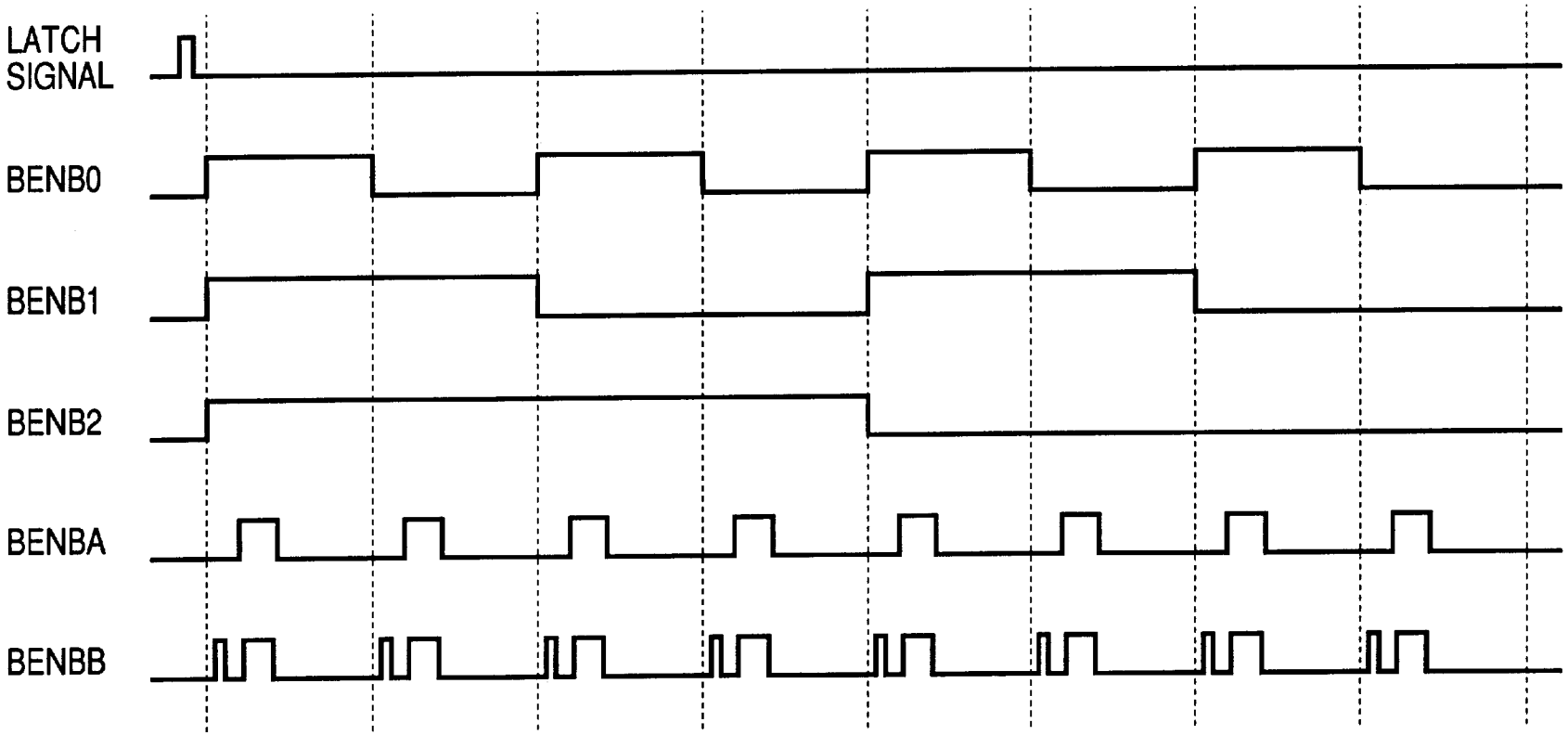
FIG. 10 is a timing chart to show signals in respective portions in a low resolution mode which is the second state.

An embodiment of the present invention will be described by reference to the drawings. FIG. 1 is a timing chart to show a single pulse and a divided pulse applied to the ink jet recording apparatus of the present embodiment; FIG. 2 is an exploded perspective view to show a state in which a front cover of the ink jet recording apparatus is removed; FIG. 3 is an exploded perspective view to show the assembly structure of the ink jet cartridge; FIG. 4 is a plan view to show the heater board; FIG. 5 is a plan view to show the shapes of the heat generating elements; FIG. 6 is a schematic diagram to show positions of nozzles relative to the print sheet; FIG. 7 is a block diagram to show the driving circuit; FIG. 8 is a schematic diagram to show the arrangement of nozzles in the main scanning direction and in the sub-scanning direction; FIG. 9 is a timing chart to show various signals for formation of small dots; and FIG. 10 is a timing chart to show various signals for formation of large dots.

The ink jet recording apparatus 1 of the present embodiment is constructed as a color printer of the serial type. As shown in FIG. 2, a guide shaft 2 is provided in parallel with the main scanning direction and a carriage unit 3 is supported by this guide shaft 2 so as to be movable in the main scanning direction. An endless timing belt 5 is stretched in a circulatable state between a pair of timing pulleys 4 and is located in parallel with the guide shaft 2. The carriage unit 3 is coupled with this timing belt 5.

This carriage unit 3 is provided with a cartridge holder 6 and an ink jet cartridge 7 is mounted in an exchangeable manner on the cartridge holder 6. Described in more detail, the cartridge holder 6 is arranged so as to be displaced in synchronism with a rotatable manual lever 8 and detachably holds the ink jet cartridge 7 in response to rotation of the manual lever 8. The cartridge unit 3 is provided with a plurality of connection terminals (not illustrated) for electrical contact with the ink jet cartridge 7, and the driving circuit is connected through flexible cable 9 to these connection terminals.

A position sensor 11 of a photocoupler is mounted on the cartridge unit 3 and a shield plate 12 is located at a position where the position sensor 11 detects it in a state in which the carriage unit 3 is at the home position. The position sensor 11 is connected to a home position unit 13 including a head recovery system.

Plural guide plates (not illustrated) and feed roller 14 form a path for successively conveying the print sheet (not illustrated) in the sub-scanning direction, at the position opposite to the ink jet cartridge 7 mounted on the carriage unit 3.

The ink jet cartridge 7 has the cartridge body 21, as shown in FIG. 3, and a tank 22 of black ink and a tank 23 of color ink liquids of Y, M, and C are detachably mounted in this cartridge body 21. Ink supply ports 24 are formed in these tanks 22, 23 and ink receiving ports 25 interconnected with the respective ink supply ports 24 are formed in the cartridge body 21.

These ink receiving ports 25 are in communication with a recording head section 26 and many nozzles 27 are formed in this recording head section 26. The heater board 28 is disposed in this recording head section 26 and heat generating elements 29 are formed at positions corresponding to the nozzles 27 in this heater board 28. The heater board 28 is connected to the connection terminals 30 formed on the side surface of the cartridge body 21 and the connection terminals (not illustrated) of the carriage unit 3 are detachably connected to the connection terminals 30.

The heater board 28 has a silicon substrate 31, as shown in FIG. 4, and heat generating element groups 32 to 35 provided for the respective colors of Y, M, and C are juxtaposed at the front edge of the surface thereof. In each of these heat generating element groups 32 to 35, many heat generating elements 29 for generating the bubble by heating the ink as described previously are placed at the rate of two in each nozzle 27 as shown in FIG. 5. Namely, partition walls (not illustrated) for forming the nozzles 27 are formed on the surface of the silicon substrate 31 and a separate silicon substrate (not illustrated) is joined onto the partition walls. Thus these serve as nozzle-forming members to form the nozzles 27.

Each of the heat generating element groups 32 to 34 for the color ink liquids of Y, M, and C corresponds to twenty four nozzles 27 placed in the density of 360 (dpi) and the heat generating element group 35 for black ink corresponds to sixty four nozzles 27. The heat generating element groups 32 to 35 are juxtaposed through a clearance corresponding to eight nozzles 27 between them. Since serial numbers from the left end of yellow (Y) to the right end of black are given to the nozzles 27 juxtaposed as described above, "1–24" are assigned to the yellow nozzles 27, "25–48" to the magenta (M) nozzles 27, "49–72" to the cyan (C) nozzles 27, and "73–136" to the black nozzles 27.

Sub-heaters 36 for the purpose of maintaining warmth of the silicon substrate 31 are provided at both ends of the heater board 28, and a rank heater 37 for measurement of resistance of the heat generating elements 29 is provided at one end. The driving circuit 38 for driving the heat generating elements 29, the sub-heaters 36, and the other elements is made of a thin film in the central area of the heater board 28 and the connection terminals 39, which are connected to this driving circuit 38, are formed at the rear edge of the heater board 28.

In the present embodiment the heat generating elements 29 are provided at the rate of two in each nozzle 27, as shown in FIG. 5, wherein each heat generating element is formed in a rectangular shape elongated in the ink ejection direction. Two heat generating elements 29 located in one nozzle 27 are juxtaposed in the direction perpendicular to the ink ejection direction, but they are located at their respective positions displaced relative to each other in the ink ejection direction. Specifically, one heat generating element 29 is located toward front while the other heat generating element 29 rear.

In the description below, the heat generating element 29 located toward the front will be referred to as front heater **29*f* and the heat generating element 29 located toward the rear as rear heater 29*b*. The front heater 29*f* is made of a thin film of metal with high resistance in a rectangular shape having the length Lf=131 ($\mu$m) and the width Wf=22 ($\mu$m), while the rear heater 29*b* is made of a thin film of metal with high resistance in a rectangular shape having the length Lb=131 ($\mu$m) and the width Wb=20 ($\mu$m). A single common electrode 40 made of a thin film of metal with low resistance is connected to the front edge of these heaters 29, and separate electrodes 41 made of a thin film of metal with low resistance are connected each to the rear edge of each heater 29*f*, 29*b*. The common electrode 40 is connected to the ground wire (not illustrated), while the separate electrodes 41 are connected to the driving circuit 38**.

This driving circuit 38 has a shift register 51, a latch circuit 52, a block selecting circuit 53, driver circuits **54*b* and 54*f*, as shown in FIG. 6, and is made of a thin film on the silicon substrate 31 as the heaters 29 etc. were. The driver circuits 54*f*, 54*b* are connected respectively to the separate electrodes 41 of the heaters 29*f*, 29*b* and are also connected to the single block selecting circuit 53. This block selecting circuit 53 is connected to the latch circuit 52 and this latch circuit 52 is connected to the shift register 51**.

The shift register 51 receives external inputs of image data and a clock signal from the driving circuit 10 of the apparatus body and holds the image data serially supplied in synchronism with the clock signal. The latch circuit 52 receives an external input of a latch signal as shown in FIG. 9 and FIG. 10, and latches the image data held in the shift register 51 in response to the latch signal.

The block selecting circuit 53 receives external inputs of three binary block select signals BENB 0-2 and transfers the image data latched in the latch circuit 52 to the driver circuits 54 while spreading the data in eight blocks by combinations of block select signals BENB 0-2, as shown in Table 1 below.

TABLE 1

| | | | | | | | | |
|---|---|---|---|---|---|---|---|---|
| BENB 0 | low | high | low | high | low | high | low | high |
| BENB 1 | low | low | high | high | low | low | high | high |
| BENB 2 | low | low | low | low | high | high | high | high |
| Yellow | 1 | 3 | 5 | 7 | 9 | 11 | 13 | 15 |
| | 2 | 4 | 6 | 8 | 10 | 12 | 14 | 16 |
| | 17 | 19 | 21 | 23 | | | | |
| | 18 | 20 | 22 | 24 | | | | |
| Magenta | 25 | 27 | 29 | 31 | 33 | 35 | 37 | 39 |
| | 26 | 28 | 30 | 32 | 34 | 36 | 38 | 40 |
| | 41 | 43 | 45 | 47 | | | | |
| | 42 | 44 | 46 | 48 | | | | |
| Cyan | 49 | 51 | 53 | 55 | 57 | 59 | 61 | 63 |
| | 50 | 52 | 54 | 56 | 58 | 60 | 62 | 64 |
| | 65 | 67 | 69 | 71 | | | | |
| | 66 | 68 | 70 | 72 | | | | |
| Black | 73 | 75 | 77 | 79 | 81 | 83 | 85 | 87 |
| | 74 | 76 | 78 | 80 | 82 | 84 | 86 | 88 |
| | 89 | 91 | 93 | 95 | 97 | 99 | 101 | 103 |
| | 90 | 92 | 94 | 96 | 98 | 100 | 102 | 104 |
| | 105 | 107 | 109 | 111 | 113 | 115 | 117 | 119 |
| | 106 | 108 | 110 | 112 | 114 | 116 | 118 | 120 |
| | 121 | 123 | 125 | 127 | 129 | 131 | 133 | 135 |
| | 122 | 124 | 126 | 128 | 130 | 132 | 134 | 136 |

Each driver circuit 54*f* or 54*b* receives an external input of pulse signal HENBA or HENBB from the driving circuit 10 and outputs this pulse signal to the heater 29*f* or 29*b* in accordance with the image data supplied from the block selecting circuit 53. The pulse signal HENBA, HENBB supplied as external inputs to the heaters 29*f*, 29*b* in this way are such that the pulse signal HENBA, supplied to the front heater 29*f* is a single pulse and the pulse signal HENBB supplied to the rear heater 29*b* is a divided pulse HENBB, as shown in FIG. 1.

The driving circuit 10 is composed of a one-chip CPU 61, and two pulse generators 62, 63, as shown in FIG. 7, and each of these pulse generators 62, 63 has a single pulse generating circuit 64, a divided pulse generating circuit 65, a changeover switch 66, and an on/off control circuit 67.

The first pulse generator 62 is connected to the heat generating element group 32 for white/black printing of the heater board 28 and the second pulse generator 63 to the heat generating element groups 33 to 35 for color printing. In these pulse generators 62, 63 the single pulse generating circuit 64 generates the single pulse HENBA in response to a reference clock and the divided pulse generating circuit 65 the divided pulse HENBB.

The single pulse generating circuit 64 is connected through the changeover switch 66 to the driver circuits 54*f* of the front heaters 29*f* and the divided pulse generating circuit 65 through the changeover switch 66 to the driver circuits 54*b* of the rear heaters 29*b*. The on/off control circuit 67 is connected to the changeover switch 66 to control connection between the pulse generating circuits 64, 65 and the heaters 29*f*, 29*b*.

The one-chip CPU 61 is connected to each of the pulse generators 62, 63 and systematically controls these according to proper programs preliminarily set. Specifically, the ink jet recording apparatus 1 of the present embodiment is arranged to be switchable between two operation modes, which are a high-resolution mode being the first state in which the image data is recorded in high density of small dots and a low-resolution mode being the second state in which the image data is recorded in low density of large dots, and the driving circuit 10 applies driving pulses to the heater board 28 in accordance with either one of these operation modes.

For example, when the high-resolution mode is selected, the one-chip CPU 61 performs such an operation according to a proper program as to double the driving frequency of the single pulse generating circuit 64 from the standard state, and control the changeover switch 66 through the on/off control circuit 67 to connect the single pulse generating circuit 64 to the driver circuits 54*f* of the front heaters 29*f* but disconnect the divided pulse generating circuit 65 from the driver circuits 54*b* of the rear heaters 29*b*.

When the low-resolution mode is selected, the one-chip CPU 61 performs such an operation according to a proper program as to set the drive frequency of the pulse generating circuits 64, 65 in the standard state, and control the changeover switch 66 through the on/off controlling circuit 67 to connect the single pulse generating circuit 64 to the driver circuits 54*f* of the front heaters 29*f* and connect the divided pulse generating circuit 65 to the driver circuits 54*b* of the rear heaters 29*b*.

In the ink jet recording apparatus 1 of the present embodiment, the divided pulse HENBB is set in such a pulse form that a pre-pulse of a period, at least, so short as not to generate a bubble in the ink and a main pulse of a period long enough to generate a bubble in the ink are consecutively given with a predetermined quiescent period in between. A single pulse HENBA is set to have a period sufficient to generate a bubble in the ink, and the total period of the pre-pulse and the main pulse in the divided pulse HENBB is set to be nearly equal to the period of the single pulse HENBA.

Specifically, the pulses are set to satisfy the following relations:

$$Pf1 \simeq 1.44 \times Pth,$$

$$Pb1 < 0.64 \times Pth,$$

$$Pb3 \simeq 1.44 \times Pth - Pb1$$

where Pth is a period necessary for bubble generation in ink by application of a pulse, Pf1 is an application period of the single pulse HENBA, Pb1 is an application period of the pre-pulse in the divided pulse HENBB, and pb3 is an application period of the main pulse.

More specifically, the setting is made so that Pb1≈0.56×Pth≈1.45 (μsec) and Pb3≈0.88×Pth≈2.90 (μsec). The quiescent period Pb2 of the divided pulse HENBB is set to be 2.35 (μsec) in which increase in the ejection amount of ink saturates. The single pulse HENBA is set so as to start at the timing of almost the midpoint of the quiescent period in the divided pulse HENBB.

The ink jet recording apparatus 1 of the present embodiment is constructed so that the various periods of the single pulse HENBA and the divided pulse HENBB as described above can be finely adjusted corresponding to the resistance of the heaters 29. Since the heaters 29 in the nozzles 27 and the rank heater 37 are made in a common process, their resistances are in a proportional relation. Thus, a rank detecting circuit (not illustrated) detects the resistance of the rank heater 37 upon start of the ink jet recording apparatus 1 and determines a rank of the heaters 29 according to the result of this detection.

TABLE 2

| | HENBA | | | | HENBB | | | |
|---|---|---|---|---|---|---|---|---|
| | Pf0 | Pf1 | Pf2 | Pf3 | Pb0 | Pb1 | Pb2 | Pb3 |
| Rank 1 | 19 | 6 | 0 | 12 | 4 | 6 | 13 | 12 |
| Rank 2 | 19 | 6 | 0 | 13 | 4 | 6 | 13 | 13 |
| Rank 3 | 19 | 7 | 0 | 13 | 4 | 7 | 13 | 13 |
| Rank 4 | 19 | 7 | 0 | 14 | 4 | 7 | 13 | 14 |
| Rank 5 | 19 | 7 | 0 | 15 | 4 | 7 | 13 | 15 |
| Rank 6 | 19 | 7 | 0 | 16 | 4 | 7 | 13 | 16 |
| Rank 7 | 19 | 8 | 0 | 16 | 4 | 8 | 13 | 16 |
| Rank 8 | 19 | 8 | 0 | 17 | 4 | 8 | 13 | 17 |
| Rank 9 | 19 | 8 | 0 | 18 | 4 | 8 | 13 | 18 |
| Rank 10 | 19 | 8 | 0 | 19 | 4 | 8 | 13 | 19 |
| Rank 11 | 19 | 8 | 0 | 20 | 4 | 8 | 13 | 20 |
| Rank 12 | 19 | 9 | 0 | 20 | 4 | 9 | 13 | 20 |
| Rank 13 | 19 | 9 | 0 | 21 | 4 | 9 | 13 | 21 |

As shown in Table 2 above, thirteen ranks are preliminarily set herein and various periods of the single pulse and divided pulse are set in each rank. Since the rank of the heaters 29 determined as described above is initially set in the driving circuit 10, the driving circuit 10 applies the single pulse HENBA and divided pulse HENBB to the heaters 29 according to the rank set therein. The unit in Table 2 is 0.181 ($\mu$sec), which corresponds to a unit time of the reference clock of the driving circuit 10 or the like.

When the ink jet cartridge 21 ejects the ink from the nozzles 27, the heaters 29 are scanned in order, and times of ejection of ink from the respective nozzles 27 thus become successively delayed. On the other hand, since the ink jet cartridge 21 is moved in the main scanning direction relative to the print sheet by the carriage unit 3, the nozzles 27 are arranged to be inclined relative to the sub-scanning direction in a mounted state on the carriage unit 3, as shown in FIG. 8.

Namely, since the array of the nozzles 27 is inclined as associated with the moving speed of the ink jet cartridge 21 and the scanning speed of the heaters 29, the ink jet cartridge 21 moves in the main scanning direction to make the ink ejected in order from the many nozzles 27, thereby forming dots linearly continuous in the sub-scanning direction and at positions of intersections of the drawing.

Described below is the ink jet recording method with the ink jet recording apparatus 1 of the present embodiment in the above-stated configuration. First, the image data is externally supplied from a host device (not illustrated), for example, such as a word processor into the ink jet recording apparatus 1 of the present embodiment, and the apparatus ejects the ink to the print sheet according to the image data to form dots of the ink, thus reproducing the image data. In the printing output of the image data in this way, the ink jet recording apparatus 1 of the present embodiment is set in one of two levels of print gradation by a command of external input given prior to the image data by manual operation of a changeover switch (not illustrated) of the apparatus body or from the host device.

For example, when the high-resolution mode being the first state is set, the single pulse generating circuit 64 of the driving circuit 10 applies the single pulse HENBA to only the front heaters **29*f* of nozzles 27 to be driven, as shown in FIG. 9**. The ejection amount of the ink is sufficiently small, so that dots are formed in a sufficiently small diameter.

When the low-resolution mode being the second state is set, the single pulse generating circuit 64 of the driving circuit 10 applies the single pulse HENBA to the front heaters **29*f* of nozzles 27 to be driven and the divided pulse generating circuit 65 applies the divided pulse HENBB to the rear heaters 29*b*, as shown in FIG. 10**. Thus, the ejection amount of the ink is sufficiently large, so that dots are formed in a sufficiently large diameter.

When one heater 29 is driven by the divided pulse HENBB, a larger amount of ink is ejected on a characteristic basis than when driven by the single pulse HENBA. Since the ink jet recording apparatus 1 of the present embodiment is arranged so that the single pulse HENBA is applied to only the front heaters **29*f* upon formation of small dots and so that the divided pulse HENBB is applied to the rear heaters 29*b* while the single pulse HENBA is applied to the front heaters 29*f*** upon formation of large dots as described above, the small dots and large dots can be formed with a sufficient difference between them, whereby two-level gradation printing can be carried out well.

The ink jet recording apparatus 1 of the present embodiment was prototyped and experiments were conducted to compare the ink jet recording apparatus 1 of the present embodiment with the conventional apparatus. With the conventional apparatus arranged to apply the divided pulse HENBB to both of the two heaters **29*f*, 29*b*, the ratio of ejection amounts of ink was "1:1.78"; whereas, with the ink jet recording apparatus 1** of the present embodiment, the ratio of ejection amounts of ink was improved up to "1:1.91," thus successfully generating the sufficient difference between the diameters of small dots and large dots.

Although the proposal of the conventional apparatus described previously also discloses that the divided pulse is applied to one heat generating element upon formation of a small dot and that the single pulse is applied to one heat generating element while the divided pulse is applied to another heat generating element upon formation of a large dot, it is clear that this arrangement further decreases the difference between the small dot and the large dot.

If the apparatus is arranged so that the single pulse HENBA is applied to only one heater **29*f* upon formation of a small dot and so that the divided pulse HENBB is applied to both of the two heaters 29*f*, 29*b* upon formation of a large dot, such apparatus will be able to form the large dot in a greater diameter than the ink jet recording apparatus 1** of the present embodiment does.

This arrangement, however, becomes very complicated in its structure because the driving circuit of front heaters **29*f* needs to generate both the single pulse HENBA and the divided pulse HENBB. It was verified that the diameter of large dot in that case was not so different from that in the case of the ink jet recording apparatus 1 of the present embodiment. This means that the ink jet recording apparatus 1 of the present embodiment can generate the sufficient difference between the small dot and large dot even with the simple structure of the heaters 29*f*, 29*b* and driving circuit 10** and that it is extremely practical from the various accounts.

In addition, the ink jet recording apparatus 1 of the present embodiment is arranged so that application of the single pulse HENBA is started at nearly the midpoint of the quiescent period of the divided pulse HENBB upon formation of large dot, whereby bubble generation in the ink by the two heaters **29*f*, 29*b* is effected almost simultaneously, thus maximizing the ejection amount of ink. Since the various periods of the respective pulses are finely adjusted based on the determination of the rank of heaters 29** upon start-up the quality of printing can be always maintained good against environmental changes or the like.

Further, since the total period of the divided pulse HENBB is equal to the period of the single pulse, energies generated by the pulse generating circuits 64, 65 of the driving circuit 10 are equal. Therefore, the ink can be ejected well by both of the single pulse HENBA and the divided pulse HENBB and it is also possible to achieve commonality of design of power supply and wiring, because loads on the circuits are also equal.

Further, in the high-resolution mode for recording the image data in high density of small dots, the operating frequency is double that in the low-resolution mode; therefore, in the high-resolution mode the image data can be recorded at the speed equivalent to that in the low-resolution mode. In addition, only the front heaters 29*f* are driven at the doubled frequency by the single pulse in the high-resolution mode; whereas, in the low-resolution mode the front heaters 29*f* are driven at the standard frequency by the single pulse while the rear heaters 29*b* by the divided pulse; since the energy amounts of the single pulse and the divided pulse are equal to each other as described above, the dissipation power in the high-resolution mode can be made equal to that in the low-resolution mode; therefore, the power supplies etc. can be utilized fully without waste.

Since the period Pth necessary for the bubble generation in the ink by application of pulse and the application period Pf1 of the single pulse HENBA are arranged to satisfy the relation of "$Pf1 \simeq 1.44 \times Pth$," the apparatus can also characteristically eject the ink on a stable basis for formation of small dot. Further, since the application period Pb1 of the pre-pulse of the divided pulse HENBB satisfies the relation of "$Pb1 < 0.64 \times Pth$," the rear heaters 29*b* can be pre-heated well up to the temperature at which no bubble is generated in the ink, by the pre-pulse. Since the application period Pb3 of the main pulse satisfies the relation of "$Pb3 \simeq 1.44 \times Pth - Pb1$" as described above, the apparatus can also characteristically eject the ink on a stable basis by the divided pulse HENBB in the same manner as by the single pulse HENBA.

It should be noted that the present invention is not limited to the above embodiment but allows various modifications and arrangements within the range not departing from the spirit and scope thereof. For example, the above embodiment exemplified the structure in which the driving circuit 10 for generating the single pulse HENBA and divided pulse HENBB was mounted in the apparatus body and in which the heaters 29 were provided in the nozzles 27 of the ink jet cartridge 7 detachably mounted on the apparatus body, but it can also be contemplated that the driving circuit 10 is also mounted in the ink jet cartridge 7 and the resultant is regarded as the ink jet recording apparatus of the present invention.

Although the above embodiment exemplified the arrangement of two heaters 29 in each nozzle 27, three or more heaters can also be provided in each nozzle. Further, the above embodiment exemplified the arrangement in which the two heaters 29 were located at their positions displaced front and rear, but these heaters 29 can also be arranged in the direction perpendicular to the ink ejection direction.

Since the present invention is constituted as described above, the invention has the effects described below in accordance with each embodiment.

For example, in the first state the single pulse is applied to only one heat generating element to eject a small amount of ink; in the second state the single pulse and divided pulse are applied respectively to the two heat generating elements to eject a large amount of ink; and thus the sufficient difference can be made between the ejection amounts of ink in the first state and in the second state; whereby the multi-level gradation printing can be carried out well by selectively recording the small dots and large dots with the sufficient difference.

Further, a large amount of ink can be ejected with certainty in the second state.

Further, the bubble can be generated well in the ink by the divided pulse.

In addition, the single pulse and divided pulse can generate the bubble in the ink with equal energy, the loads can be equalized on the single pulse applying means and on the divided pulse applying means, and the ink can be ejected similarly stably by the single pulse and the divided pulse.

The bubble can be generated well within the ink by the single pulse and the divided pulse, and the sufficient difference can be produced between the small dot and the large dot.

What is claimed is:

1. An ink jet recording apparatus, comprising:

a nozzle for ejecting ink;

a plurality of heat generating elements disposed inside said nozzle;

single pulse applying means for applying a single pulse to at least one of said plurality of heat generating elements, the single pulse causing one ejection of the ink from said nozzle upon a single application thereof;

divided pulse applying means for applying the single pulse to at least one of said plurality of heat generating elements and for applying a divided pulse to at least one of other said plurality of heat generating elements, the divided pulse causing one ejection of the ink from said nozzle upon a single application thereof; and operation control means for performing a changeover between a first state in which said single pulse applying means is operated and a second state in which said divided pulse applying means is operated.

2. An ink jet recording apparatus according to claim 1, wherein, in the second state, said operation control means actuates said divided pulse applying means to apply the single pulse and the divided pulse at respective times to achieve almost simultaneous generation of bubbles in the ink.

3. An ink jet recording apparatus according to claim 1, wherein the divided pulse is set so that a pre-pulse, of a pulse application period less than that required to generate a bubble in the ink, and a main pulse, of a pulse application period long enough to generate a bubble in the ink, are consecutively provided with a predetermined quiescent period in between.

4. An ink jet recording apparatus according to claim 3, wherein an application period of the single pulse is nearly equal to a total application period of the divided pulse which includes the application period of the pre-pulse and the application period of the main pulse.

5. An ink jet recording apparatus according to claim 3, wherein the following relations are satisfied:

$$Pf1 \simeq 1.44 \times Pth,$$

$$Pb1 < 0.64 \times Pth,$$

$$Pb3 \simeq 1.44 \times Pth - Pb1,$$

where Pth is a pulse application period necessary for generation of a bubble in the ink by application of a pulse, Pf1 is an application period of the single pulse, Pb1 is the application period of the pre-pulse of the divided pulse, and Pb3 is the application period of the main pulse of the divided pulse.

6. An ink jet recording method for driving a plurality of heat generating elements disposed inside a nozzle for ejecting ink, comprising the steps of:

applying, in a first state, a single pulse to at least one of the plurality of heat generating elements, the single pulse causing one ejection of the ink from the nozzle upon a single application thereof;

applying, in a second state, the single pulse to at least one of the plurality of heat generating elements and applying a divided pulse to at least one other of the plurality of heat generating elements, the divided pulse causing one ejection of the ink from the nozzle upon a single application thereof; and performing a changeover between the first state and the second state.

7. An ink jet recording method according to claim 6, wherein, in the second state, the single pulse and the divided pulse are applied at respective times to achieve almost simultaneous generation of bubbles in the ink.

8. An ink jet recording method according to claim 6, wherein the divided pulse is set so that a pre-pulse, of a pulse application period less than that required to generate a bubble in the ink, and a main pulse, of a pulse application period long enough to generate a bubble in the ink, are consecutively provided with a predetermined quiescent period in between.

9. An ink jet recording method according to claim 8, wherein an application period of the single pulse is nearly equal to a total application period of the divided pulse which includes the application period of the pre-pulse and the application period of the main pulse.

10. An ink jet recording method according to claim 8, wherein the following relations are satisfied:

$$Pf1 \simeq 1.44 \times Pth,$$

$$Pb1 < 0.64 \times Pth,$$

$$Pb3 \simeq 1.44 \times Pth - Pb1,$$

where Pth is a pulse application period necessary for generation of a bubble in the ink by application of a pulse, Pf1 is an application period of the single pulse, Pb1 is the application period of the pre-pulse of the divided pulse, and Pb3 is the application period of the main pulse of the divided pulse.

11. An ink jet recording apparatus, comprising:

a nozzle for ejecting ink;

a plurality of heat generating elements disposed inside said nozzle;

a circuit that generates a single pulse that causes one ejection of the ink from said nozzle upon single application thereof;

a circuit that generates a divided pulse that causes one ejection of the ink from said nozzle upon a single application thereof; and controlling means for applying the single pulse to at least one of said plurality of heat generating elements and for applying the divided pulse to at least one other heat generating element of said plurality of heat generating elements.

12. An ink jet gradation recording method for effecting gradation recording by driving a plurality of heat generating elements disposed inside a nozzle, said method comprising the steps of:

applying a single pulse to at least one heat generating element of the plurality of heat generating elements, the single pulse causing one ejection of the ink from the nozzle upon a single application thereof;

applying a divided pulse to at least one heat generating element of the plurality of heat generating elements, the divided pulse causing one ejection of the ink upon a single application thereof; and changing between an application of a single pulse and an application of a divided pulse in the nozzle in accordance with a gradation level.

13. An apparatus according to claim 1, wherein said divided pulse applying means applies the single pulse to the at least one of said plurality of heat generating elements and applies the divided pulse to a different one of said plurality of heat generating elements.

14. A method according to claim 6, wherein, in the second state, the single pulse is applied to the at least one of the plurality of heat generating elements and the divided pulse is applied to a different one of the plurality of heat generating elements.

* * * * *

UNITED STATES PATENT AND TRADEMARK OFFICE

CERTIFICATE OF CORRECTION

PATENT NO. : 6,257,691 B1
DATED : July 10, 2001
INVENTOR(S) : Iwasaki et al.

It is certified that error appears in the above-identified patent and that said Letters Patent is hereby corrected as shown below:

Column 6,
Line 43, "29 rear." should read -- 29 is located toward the rear --.

Signed and Sealed this

Fourteenth Day of May, 2002

*Attest:*

*Attesting Officer*

JAMES E. ROGAN
*Director of the United States Patent and Trademark Office*